US008839886B2

(12) United States Patent
Jones et al.

(10) Patent No.: US 8,839,886 B2
(45) Date of Patent: Sep. 23, 2014

(54) DRILL BIT WITH RECESSED CENTER

(75) Inventors: Mark L. Jones, Draper, UT (US); Kyle E. Johnson, Murray, UT (US)

(73) Assignee: Atlas Copco Secoroc LLC, Grand Prairie, TX (US)

( * ) Notice: Subject to any disclaimer, the term of this patent is extended or adjusted under 35 U.S.C. 154(b) by 494 days.

(21) Appl. No.: 12/942,971

(22) Filed: Nov. 9, 2010

(65) Prior Publication Data

US 2011/0108326 A1 May 12, 2011

Related U.S. Application Data

(60) Provisional application No. 61/259,609, filed on Nov. 9, 2009.

(51) Int. Cl.
*E21B 10/02* (2006.01)
*E21B 10/43* (2006.01)

(52) U.S. Cl.
CPC ..... *E21B 10/43* (2013.01)
USPC ..... 175/403; 175/58

(58) Field of Classification Search
USPC ..... 175/332, 403, 58
See application file for complete search history.

(56) References Cited

U.S. PATENT DOCUMENTS

| | | | | |
|---|---|---|---|---|
| 1,873,814 | A | 8/1932 | Brewster | |
| RE26,669 | E * | 9/1969 | Henderson | 175/405.1 |
| 3,635,296 | A | 1/1972 | Lebourg | |
| 3,727,704 | A | 4/1973 | Abplanalp | |
| 4,234,048 | A * | 11/1980 | Rowley | 175/430 |
| 4,352,400 | A | 10/1982 | Grappendorf et al. | |
| 4,440,247 | A | 4/1984 | Sartor | |
| 4,538,691 | A | 9/1985 | Dennis | |
| 4,604,106 | A | 8/1986 | Hall et al. | |
| 4,640,374 | A | 2/1987 | Dennis | |
| 4,694,916 | A | 9/1987 | Ford | |
| 4,815,342 | A | 3/1989 | Brett et al. | |
| 4,858,706 | A | 8/1989 | Lebourgh | |
| 4,991,670 | A | 2/1991 | Fuller et al. | |
| 5,131,478 | A | 7/1992 | Brett et al. | |
| 5,176,212 | A | 1/1993 | Tandberg | |
| 5,238,075 | A | 8/1993 | Keith et al. | |
| 5,361,859 | A | 11/1994 | Tibbitts | |
| 5,366,031 | A | 11/1994 | Rickards | |
| 5,427,191 | A | 6/1995 | Rickards | |
| 5,443,565 | A | 8/1995 | Strange | |
| 5,655,614 | A | 8/1997 | Azar | |
| 5,735,360 | A | 4/1998 | Engstrom | |

(Continued)

FOREIGN PATENT DOCUMENTS

| | | |
|---|---|---|
| FR | 1330147 | 6/1963 |
| GB | 694925 | 7/1953 |
| GB | 1357640 | 6/1974 |

*Primary Examiner* — Brad Harcourt
*Assistant Examiner* — Catherine Loikith
(74) *Attorney, Agent, or Firm* — Brinks Gilson & Lione; John C. Bacoch

(57) ABSTRACT

A drill bit configured for boring holes or wells into the earth include a plurality of blades configured with a recessed center such that the blades cut a core therebetween. Cutting elements in the recessed center are configured to cut and remove the core. The recessed center has a first diameter at a height from the cutting elements in the recessed center and a second diameter smaller than the first diameter such that the confining stress on the core is relieved prior to being cut by the cutting elements in the recessed center.

14 Claims, 11 Drawing Sheets

(56) References Cited

U.S. PATENT DOCUMENTS

| | | | |
|---|---|---|---|
| 6,109,368 | A | 8/2000 | Goldman et al. |
| 6,246,974 | B1 | 6/2001 | Jelley et al. |
| 6,695,073 | B2 | 2/2004 | Glass et al. |
| 7,693,695 | B2 | 4/2010 | Huang et al. |
| 7,694,756 | B2 | 4/2010 | Hall et al. |
| 7,882,907 | B2 | 2/2011 | Engstrom |
| 2007/0261890 | A1 | 11/2007 | Cisneros |
| 2008/0035387 | A1 | 2/2008 | Hall et al. |

* cited by examiner

DRILL BIT WITH RECESSED CENTER

PRIORITY CLAIM

This application claims the benefit of and priority from U.S. Provisional Patent Application No. 61/259,609 filed on Nov. 9, 2009 that is incorporated in its entirety for all purposes by this reference.

FIELD

The present application relates to drill bits used for earth boring, such as water wells; oil and gas wells; injection wells; geothermal wells; monitoring wells, mining; and, other operations in which a well-bore is drilled into the Earth.

BACKGROUND

Specialized drill bits are used to drill well-bores, boreholes, or wells in the earth for a variety of purposes, including water wells; oil and gas wells; injection wells; geothermal wells; monitoring wells, mining; and, other similar operations. These drill bits come in two common types, roller cone drill bits and fixed cutter drill bits.

Wells and other holes in the earth are drilled by attaching or connecting a drill bit to some means of turning the drill bit. In some instances, such as in some mining applications, the drill bit is attached directly to a shaft that is turned by a motor, engine, drive, or other means of providing torque to rotate the drill bit.

In other applications, such as oil and gas drilling, the well may be several thousand feet or more in total depth. In these circumstances, the drill bit is connected to the surface of the earth by what is referred to as a drill string and a motor or drive that rotates the drill bit. The drill string typically comprises several elements that may include a special down-hole motor configured to provide additional or, if a surfaces motor or drive is not provided, the only means of turning the drill bit. Special logging and directional tools to measure various physical characteristics of the geological formation being drilled and to measure the location of the drill bit and drill string may be employed. Additional drill collars, heavy, thick-walled pipe, typically provide weight that is used to push the drill bit into the formation. Finally, drill pipe connects these elements, the drill bit, down-hole motor, logging tools, and drill collars, to the surface where a motor or drive mechanism turns the entire drill string and, consequently, the drill bit, to engage the drill bit with the geological formation to drill the well-bore deeper.

As a well is drilled, fluid, typically a water or oil based fluid referred to as drilling mud is pumped down the drill string through the drill pipe and any other elements present and through the drill bit. Other types of drilling fluids are sometimes used, including air, nitrogen, foams, mists, and other combinations of gases, but for purposes of this application drilling fluid and/or drilling mud refers to any type of drilling fluid, including gases. In other words, drill bits typically have a fluid channel within the drill bit to allow the drilling mud to pass through the bit and out one or more jets, ports, or nozzles. The purpose of the drilling fluid is to cool and lubricate the drill bit, to stabilize the well-bore from collapsing, to prevent fluids present in the geological formation from entering the well-bore, and to carry fragments or cuttings removed by the drill bit up the annulus and out of the well-bore. While the drilling fluid typically is pumped through the inner annulus of the drill string and out of the drill bit, drilling fluid can be reverse-circulated. That is, the drilling fluid can be pumped down the annulus of the well-bore (the space between the exterior of the drill pipe and the wall of the well-bore), across the face of the drill bit, and into the inner fluid channels of the drill bit through and up into the drill string.

Roller cone drill bits were the most common type of bit used historically and typically featured two or more rotating cones with cutting elements, or teeth, on each cone. Roller cone drill bits typically have a relatively short period of use as the cutting elements and support bearings for the roller cones typically wear out and fail after only 50 hours of drilling use.

Because of the relatively short life of roller cone bits, fixed cutter drill bits that employ very durable polycrystalline diamond compact (PDC) cutters, tungsten carbide cutters, natural or synthetic diamond, other hard materials, and combinations thereof, have been developed. These bits are referred to as fixed cutter bits because they employ cutting elements positioned on one or more fixed blades in selected locations or randomly distributed. Unlike roller cone bits that have cutting elements on a cone that rotates, in addition to the rotation imparted by a motor or drive, fixed cutter bits do not rotate independently of the rotation imparted by the motor or drive mechanism. Through varying improvements, the durability of fixed cutter bits has improved sufficiently to make them cost effective in terms of time saved during the drilling process when compared to the higher, up-front cost to manufacture the fixed cutter bits.

Unfortunately, fixed cutter bits have several disadvantages. The first is that fixed cutter bits often have problems with stability while drilling. Specifically, fixed cutter bits often undergo what is referred to as whirl and/or dynamic instability, which often is characterized by shocks, or chaotic movement of the drill bit within the well-bore that takes the form of suddenly stopping, i.e., rotation momentarily ceases at the drill bit or at just a portion of the drill bit but not within the drill string; sudden release of the energy stored within the drill string when the bit begins to rotate again; uncontrolled and rapid movement laterally against the wall of the well-bore; and bouncing, or rapid movement in the longitudinal direction parallel to the long axis of the well-bore. The severity of these movements can exceed 100 times the force of gravity and can damage the drill bit, the drill string, surface equipment, and other items. In addition, the excess energy released in these various shocks is not used to drill the well-bore, resulting in a slower rate of drilling, or rate-of-penetration (ROP), and possibly damaging the cutters and/or the drill bit, leading to increased drilling costs.

Various methods have been attempted to reduce the occurrence of whirl and/or dynamic instability, but none have been wholly satisfactory. Computer modeling to balance the anticipated forces on the drill bit provides some improvement, but cannot account for the variety of factors encountered during the drilling process. Using more, smaller diameter cutting elements and more blades on the bit improves the stability of the bit because more points of contact between the drill bit and the well-bore exist, but such a configuration typically costs more to manufacture and reduces the rate at which the fixed cutter bit drills the well-bore, thereby increasing the total cost. Conversely, using a fixed cutter bit with larger diameter cutting elements and fewer blades and/or fewer number of cutters typically improves the rate-of-penetration and lowers the cost to manufacture the bit, but stability is reduced.

In addition to resisting whirl and/or dynamic instability, the drill bit is part of a dynamic system with both known and unknown inputs. While the inputs into the system at the surface may be known, e.g., type of bit, force or weight applied to the bit at the surface, torque applied at the surface, the actual effect of these surface inputs is typically more variable and less predictable at the drill bit and is only occasionally known through the use of specialized measurement tools located near the drill bit that are capable of transmitting that information to the driller/user at the surface. Such specialized tools are rarely run because of the cost, thus the actual conditions and inputs to which the bit is exposed is typically unknown or known only in partial detail, thus requiring educated guess-work to modify the inputs to improve the operation of the drill bit.

Unfortunately, drill bits typically have a small range of operating conditions in which they operate effectively, such as remaining stable while rotating (which is more than just avoiding whirl) and efficiently drilling subsurface geological formations. Thus, there exists a need for a drill bit that operates efficiently and remains rotational stable over a wide range of conditions.

Further compounding the above problems, drill bits that drill (optimally) a round bore-hole have cutters located at the center of the drilling face, or crown, as will be described below. As these cutters are aligned with or within a close radial distance to the axis of rotation, these cutters have a proportionally low rotational velocity compared to those cutters located at or near the maximum radial distance from the center of the drill bit. This makes the drilling or cutting of the formation near the axis of rotation correspondingly more difficult.

Thus, there exists a need for a cost-effective, stable fixed cutter drill bit that provides improved stability and improved ability to cut or drill a formation near the axis of rotation of the drill bit without sacrificing rate-of-penetration.

SUMMARY

Embodiments of the present invention include a drill bit that has a connection that allows for the drill bit to be removably attached or connected to a means of providing a rotational force. The drill bit includes a body that includes a flank portion and a crown, or cone, portion and a plurality of blades positioned thereabout. The plurality of blades each have a plurality of cutting elements positioned and supported thereon, the plurality of cutting elements typically of the type referred to as polycrystalline diamond compacts, or PDCs, tungsten carbide, synthetic or natural diamond, and other hard materials. A first plurality of blades includes one or more cutting elements generally positioned in the flank portion and shoulder portion of the blades but few to no cutting elements generally positioned in the crown portion. The first plurality of blades partially define a boundary of a recessed portion therebetween, the recessed portion falling within the cone or crown portion of the drill bit. A plurality of cutting elements are positioned within the recessed portion within the cone or crown portion of the drill bit.

In use, the cutting elements of the first plurality of blades cut or drill a bore-hole and, in the process, create a core or column of the formation within the recessed center of the drill bit. The cutting elements positioned within the recessed center of the drill bit subsequently cut the core that is positioned within the recessed center as will be described in more detail below. The recessed center has a first diameter at a height from the cutting elements in the recessed center and a second diameter smaller than the first diameter such that the confining stress on the core is relieved prior to being cut by the cutting elements in the recessed center.

Other configurations of the blades, blade portions, and cutting elements, are disclosed herein and fall within the scope of the disclosure. In addition, methods of manufacturing various embodiments of the drill bit are disclosed herein.

As used herein, "at least one," "one or more," and "and/or" are open-ended expressions that are both conjunctive and disjunctive in operation. For example, each of the expressions "at least one of A, B and C," "at least one of A, B, or C," "one or more of A, B, and C," "one or more of A, B, or C" and "A, B, and/or C" means A alone, B alone, C alone, A and B together, A and C together, B and C together, or A, B and C together.

Various embodiments of the present inventions are set forth in the attached figures and in the Detailed Description as provided herein and as embodied by the claims. It should be understood, however, that this Summary does not contain all of the aspects and embodiments of the one or more present inventions, is not meant to be limiting or restrictive in any manner, and that the invention(s) as disclosed herein is/are and will be understood by those of ordinary skill in the art to encompass obvious improvements and modifications thereto.

Additional advantages of the present invention will become readily apparent from the following discussion, particularly when taken together with the accompanying drawings.

BRIEF DESCRIPTION OF THE DRAWINGS

To further clarify the above and other advantages and features of the one or more present inventions, reference to specific embodiments thereof are illustrated in the appended drawings. The drawings depict only typical embodiments and are therefore not to be considered limiting. One or more embodiments will be described and explained with additional specificity and detail through the use of the accompanying drawings in which.

The drawings are not necessarily to scale.

DETAILED DESCRIPTION

Figure 1:
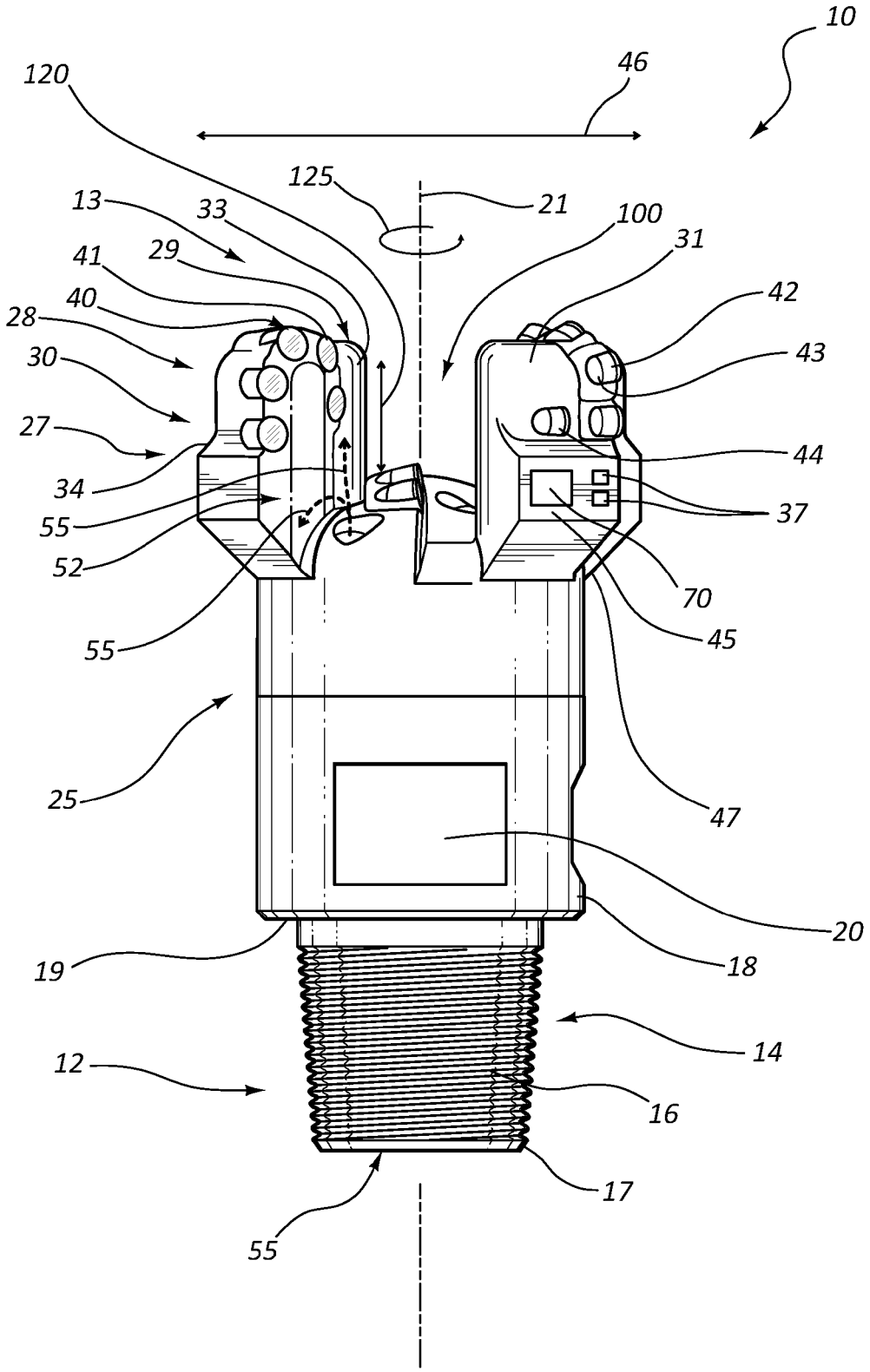
FIG. 1 is a side-view of an embodiment of a drill bit.
Figure 5:
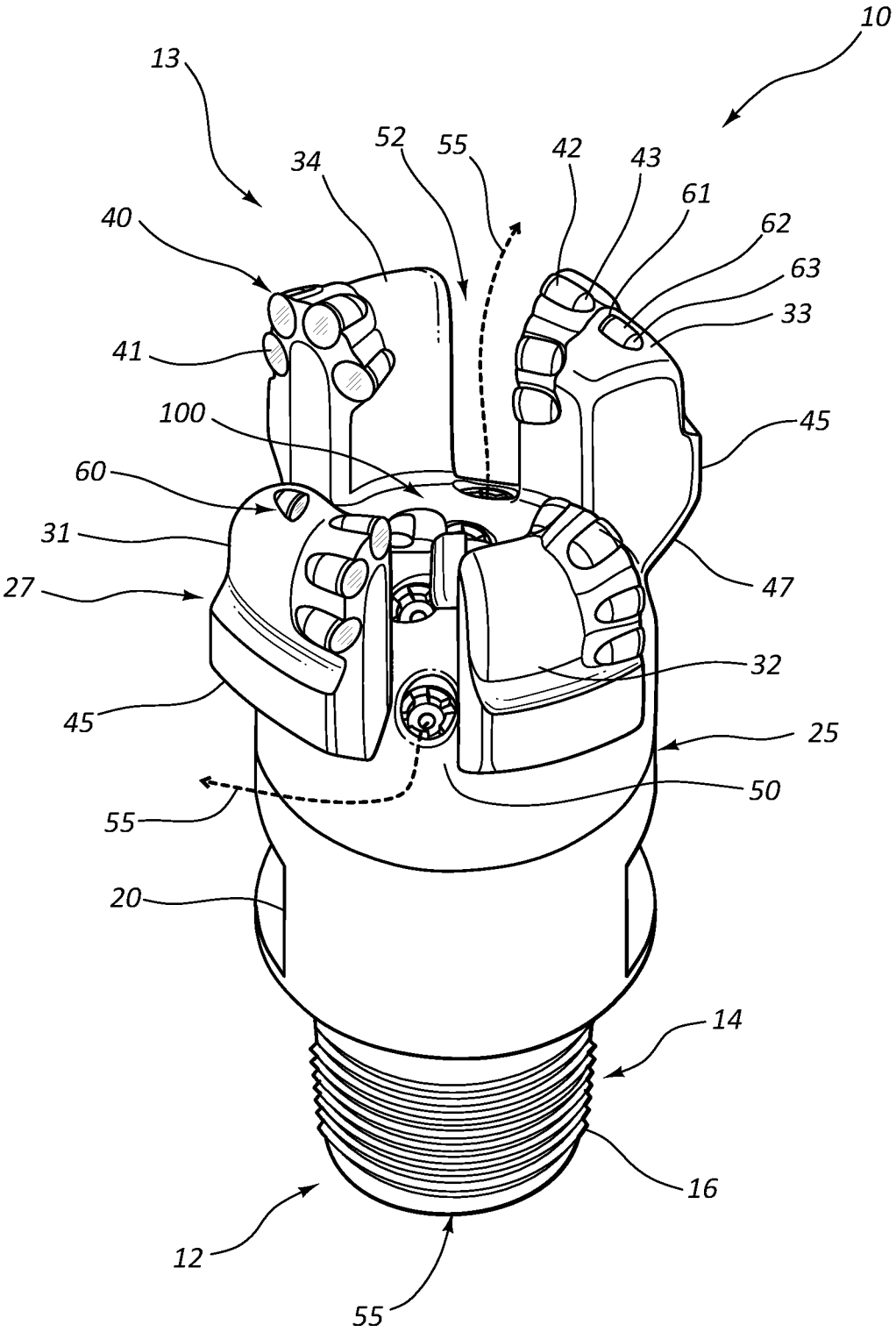
FIG. 5 is an isometric view of the drill bit in FIG. 1.
Figure 6:
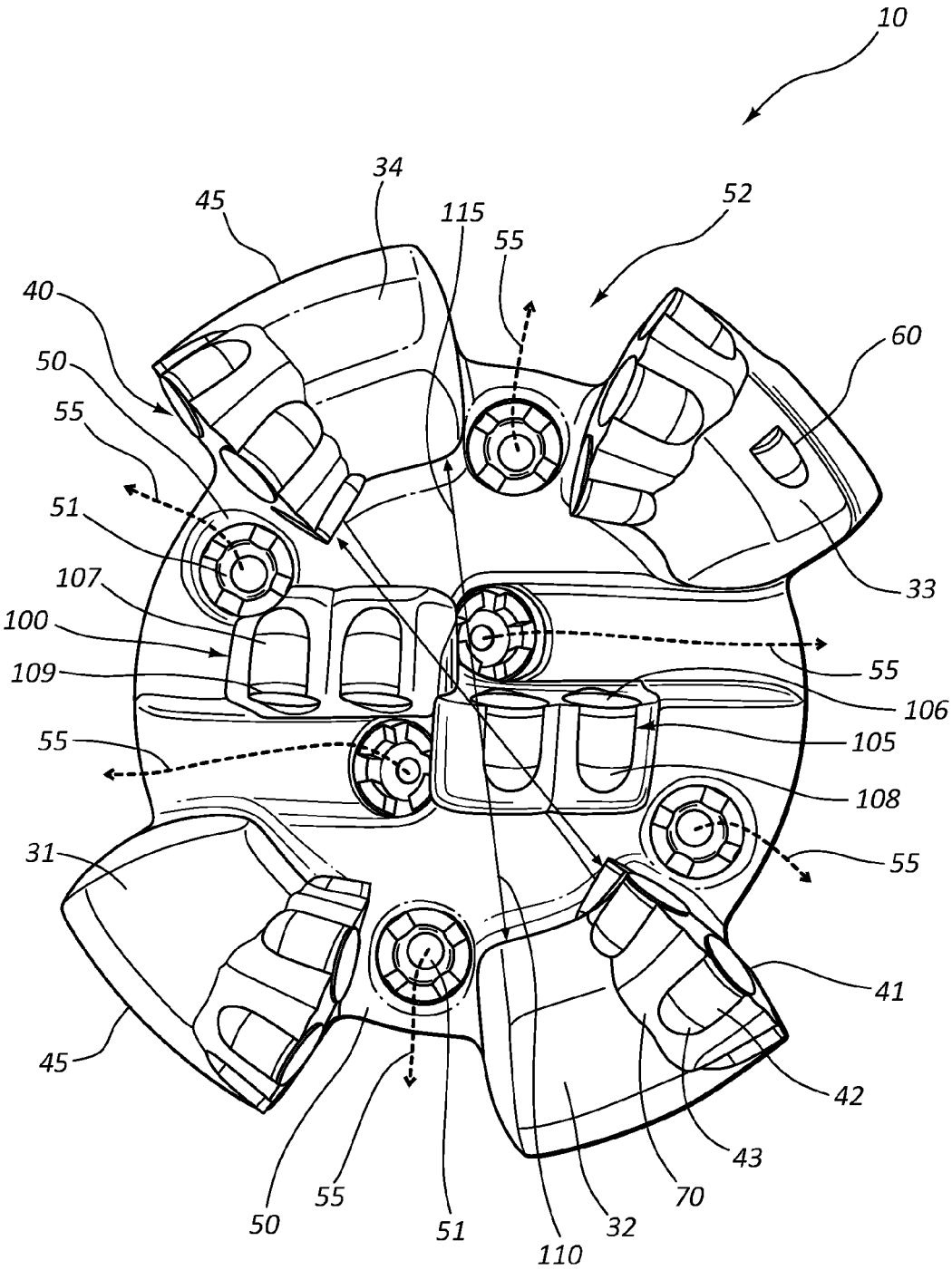
FIG. 6 is a top-view of the drill bit in FIG. 1.

FIGS. 1, 5 and 6 illustrate various views and embodiments of a drill bit 10 configured to drill well-bores in the earth. The drill bit 10 is capable of drilling oil and gas wells onshore and offshore; geothermal wells; water wells; monitoring and/or sampling wells; injection wells; directional wells, including horizontal wells; bore holes in mining operations; bore holes for pipelines and telecommunications conduits; and other types of wells and boreholes.

The drill bit 10 includes a first end 12 that includes a shank or connection means 14 configured to couple or mate the drill bit 10 to a drill string or a drill shaft that is coupled to a means of providing rotary torque or force, such as a motor, downhole motor, drive at the surface, or other means, as described above in the background. FIG. 1 illustrates a typical pin connection with threads 16 that have a chamfer 17 configured to reduce stress concentrations at the end of the threads 16 and to ease mating with the box connection in the drill string, a shank shoulder 18, and the sealing face 19 of the connection. Of course, the connection means can be a box connection as known in the art, bolts, welded connection, joints, and other means of connecting the drill bit 10 to a motor, drill string, drill, top drive, downhole turbine, or other means of providing a rotary torque or force. The threads typically are of a type described as an American Petroleum Institute (API) standard connection of various diameters as known in the art, although other standards and sizes fall within the scope of the disclosure. The threads 16 are configured to operably couple with the threads of a corresponding or analogue box connection in the drill string, collar, downhole motor, or other connection to the bit as known in the art. The sealing face 19 provides a mechanical seal between the drill bit 10 and the drill string and prevents any drilling fluid passing through the inner diameter of the drill string and the drill bit 10 from leaking out.

The embodiments of the drill bit 10 include a breaker slot 20 configured to accept a bit breaker therein. The bit breaker is used to connect or mate the drill bit 10 to the drill string and provides a way to apply torque to the drill bit 10 (or to prevent the drill bit 10 from moving as torque is applied to the drill string) while the drill bit 10 and the drill string are being coupled together or taken apart.

The bit body 25 includes one or more drill bit blades 30 connected thereto that extend past the bit body 25 in both a radial direction from the centerline 21 and a vertical direction towards and proximate to a second end 13 of the drill bit 10, as illustrated in FIG. 1, the bit body 25 being attached or fixedly coupled to the connection 14. The bit body 25 can be formed integrally with the drill bit blades 30, such as being milled out of a single steel blank. Alternatively, the drill bit blades 30 can be welded to the bit body. Another embodiment of the bit body 25 and blades 30 is one formed of a matrix, typically a tungsten carbide matrix with a nickel binder, sintered in a mold of a desired shape under temperature and pressure such that the drill bit blades 30 are integrally formed with the bit body 25. A steel blank in the general shape of the bit body 25 and the drill blades 30 can be used to form a scaffold and/or support structure for the matrix. The bit body 25 also can be formed integrally with the connection 14 from a steel blank or a steel connection 14 can be welded to the bit body 25.

The drill bit 10 includes one or more blades 30 that includes a cone section 29 within a first radius proximate the centerline 21 of the drill bit 10; a blade flank section 28 spaced laterally away at a greater radial distance from the centerline 21 than the cone section 29; a blade shoulder section 27 spaced further laterally away at a greater radial distance from the centerline 21 than the blade the flank section 28; and a gauge (or gage) pad 45 typically proximate the greatest radial distance, or one-half the bit diameter 46 of the drill bit 10, from the centerline 21 and proximate the bit body 25. In other embodiments, the gauge pad 45 is less than the greatest radial distance. The gauge pad 45 optionally includes a crown chamfer 47 adjacent to the bit body 25.

The plurality of blades 30 are configured such that a recessed portion 100 of the drill bit 10 exists between the plurality of blades 30. In other words, the plurality of blades 30 define, in part, the recessed portion of 100 as best illustrated in FIGS. 5 and 6. The recessed portion 100 includes at least one and, more preferably, a plurality of recessed cutting elements 105 positioned therein at a height or distance 120 from the end of the plurality of blades furthest away in a direction along the axis 21 from the recessed cutting elements 105.

Figure 9:
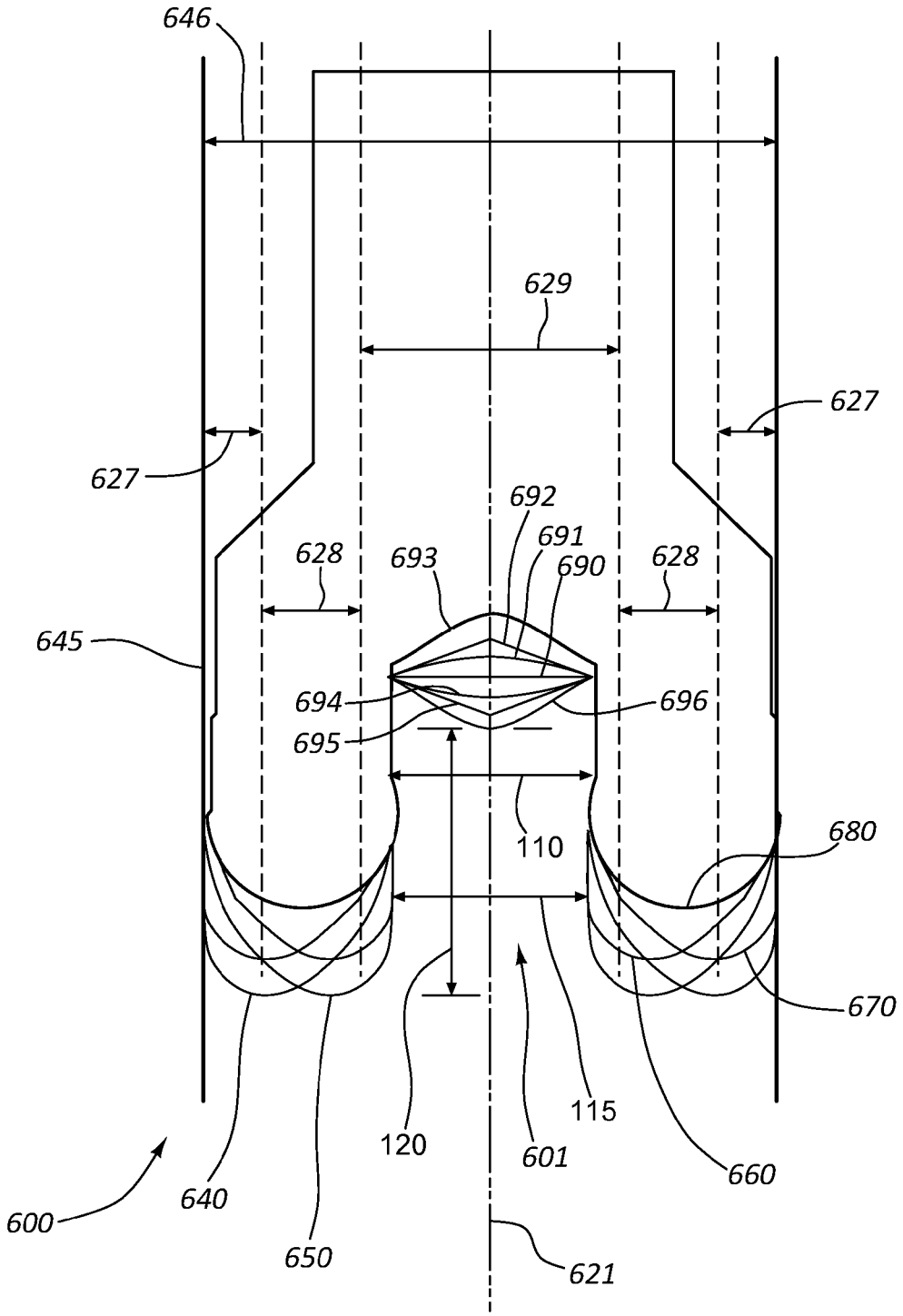
FIG. 9 is a side view of various embodiments of blade profiles of the drill bit in FIG. 1.

The relative positions of the cone section 29, blade flank section 28, blade shoulder section 27, and gauge pad section 45 with respect to the bit centerline are better illustrated in the diagram of various blade profiles 600 illustrated in FIG. 9. The centerline of an embodiment of the drill bit 10 is illustrated by the centerline 621 in FIG. 9 and the maximum diameter of the drill bit 10 is illustrated as the gauge diameter 646, which corresponds with the gauge diameter 46 illustrated in FIG. 1.

Various, non-limiting examples of profiles of embodiments of blades 30 are illustrated as lines 640; 650; 660; 670; and 680. Various, non-limiting examples of the profiles of the recessed cutting elements 105 in the recessed center 601 of the drill bit 10 include generally or substantially planar and/or substantially normal profile 690 relative to the centerline 621; various non-limiting examples of concave profiles 691, 692, and 693; and various non-limiting examples of convex profiles 694, 695, and 696. Other profiles as would be understood by one of skill in the art fall within the scope of the disclosure. The profiles 600 illustrate the aggregate profile of the blades 30 and the recessed cutting elements 105 in the recessed center 601. In other words, the blades 30 and the recessed cutting elements 105 in the recessed center 601, taken as a whole, would generally appear as the embodiment of the profiles 600 if all of the blades 30 and the recessed cutting elements 105 in the recessed center 601 were laid flat on a plane through the centerline 621.

Still referring to FIG. 9, the cone section 29 of drill bit 10 generally falls within the cone diameter 629. Of course, it will be understood that the cone section 629 may extend slightly more or less than the cone diameter 629 as illustrated because the cone diameter 629 is shown for illustrative and qualitative purposes. In other words, the cone section 629 encompasses the recessed center 601 and that portion of the blades 30, if any, relatively closest to the centerline 621 of the drill bit 10.

The blade flank section 28 of the drill bit 10 falls within the blade flank section 628 illustrated adjacent to and at a further radial distance from the centerline 621 than the cone section 629 in FIG. 9. Of course, it will be understood that the blade flank section 628 may extend slightly more or less than the blade flank section 628 as illustrated because the blade flank section 628 is shown for illustrative and qualitative purposes. In other words, the blade flank section 628 encompasses that portion of the blades 30 relatively further from the centerline 621 than the cone section 629 but not as far as the blade shoulder section 627.

The blade shoulder section 27 of the drill bit 10 falls within the blade shoulder section 627 illustrated adjacent to and at a further radial distance from the centerline 621 than the cone section 629 and the blade flank section 628 in FIG. 9. Of course, it will be understood that the blade shoulder section 627 may extend slightly more or less than the blade shoulder section 627 as illustrated because the blade shoulder section 627 is shown for illustrative and qualitative purposes. In other words, the blade shoulder section 627 encompasses that portion of the blades 30 relatively further from the centerline 621 than the cone section 629 and the blade flank section 628 but not as far as the blade gauge section 645.

Returning to FIGS. 1, 5, and 6 the drill bit 10 with blades 30 is illustrated to have four distinct blades 31, 32, 33, and 34 that are best illustrated in FIG. 6. Each of the blades 31 through 34 is slightly different for the reasons that will be discussed below, including the shape of each blade and the placement of the cutters 40 along the blade. The blades 30 can have a shape selected for various factors, including the formation drilled, the size of the hole desired, the capability of the equipment (drilling rig, drill string, etc.), cost, and other considerations.

Figure 8:
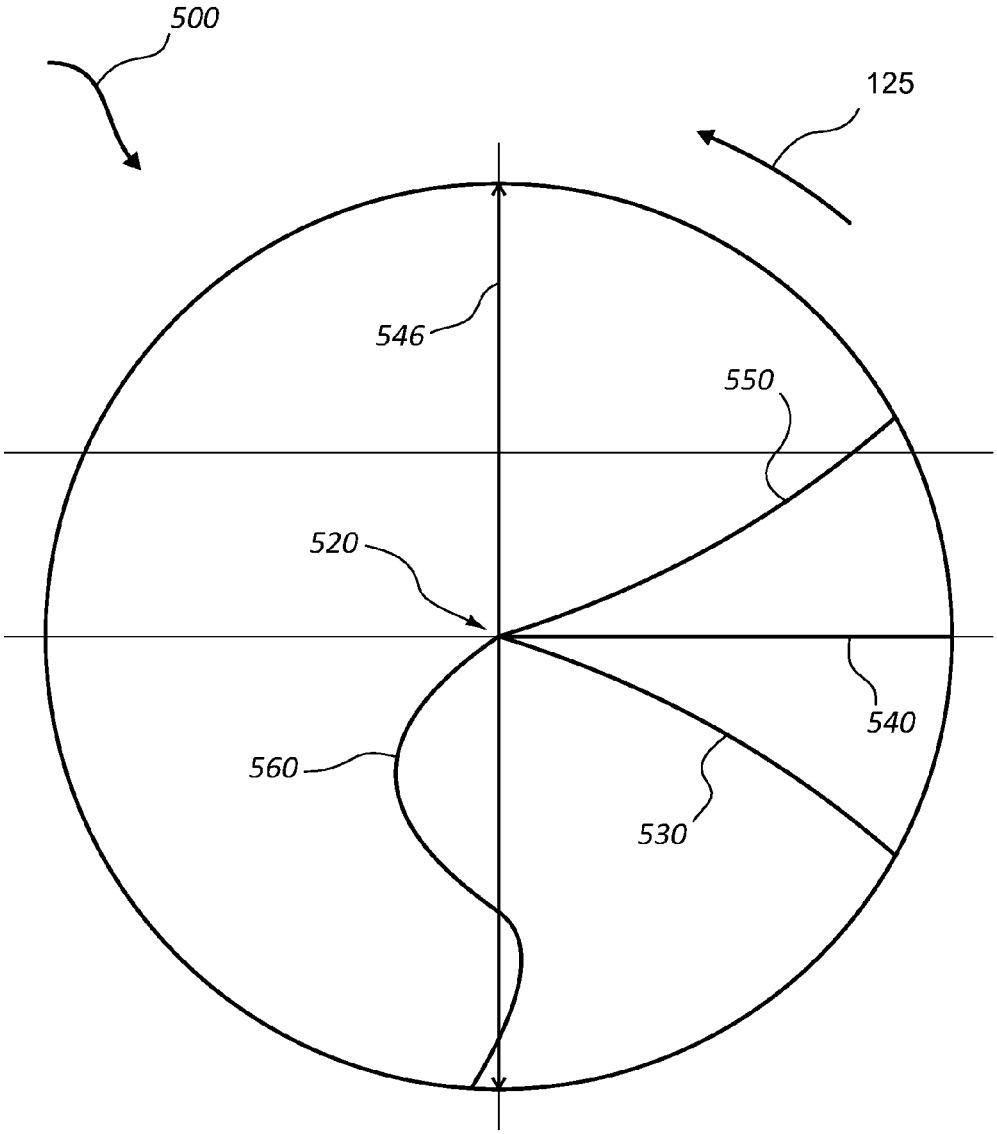
FIG. 8 is a top view of various embodiments of blade profiles of the drill bit in FIG. 1.

As an example, FIG. 8 illustrates several embodiments of blade shapes 500 with a gauge diameter 546 as if viewed by looking directly at the crown section 29 of the drilling bit 10. One embodiment of the blade shapes is blade shape 530 that has a trailing radius of curvature relative to the direction of rotation 125. The straight blade shape 540 is qualitatively the same as that of blades 30 illustrated in FIGS. 1, 5, and 6 and has substantially no radius of curvature and is perpendicular to the direction of rotation 125 of the drill bit. Yet another embodiment includes a blade shape 550 that has a leading radius of curvature.

Of course, it will be understood that different blades in a given drill bit might have different blade shapes, lines, arcs, and or splines, either more or less aggressive, than any other given blade on the drill bit. Further, a blade shape need not remain constant, either straight or have a constant radius of curvature as its radial distance from the center of the bit increases. For example, blade shape 560 indicates a blade whose radius of curvature changes significantly as the radial distance from the center 520 increases, from a trailing radius of curvature to a leading radius of curvature, something that might be suitable for drilling horizontal wells along very thin geological formations of different hardness.

Turning back to FIGS. 1, 5, and 6, a particular embodiment of the drill bit 10 includes a plurality of blades 31-34 that have cutters 40 selectively positioned at various locations on the blades, including cone section 29, the blade flank section 28, and the blade shoulder section 27, amongst other places. Optionally, the cutters 40 can be positioned in all or a subset of these sections.

The cutters 40 and 105 illustrated in the figures are of a polycrystalline diamond compact (PDC) type, but cutters of the other materials, such as tungsten carbide, natural or synthetic diamond, and other hard materials can be used. The embodiment of the cutters 40 and 105 include the PDC cutting element 41, 106 configured with a side that couples to and, preferably, mechanically interlocks with the substrate 42, 107, which are then positioned in a pocket 43, 108 of a blade, for example, as known in the art.

The cutters 40, 105 are positioned on the various blades 30 and in the recessed center 100 at selected radial distances from the centerline 21 depending on various factors, including the desired rate-of-penetration, hardness and abrasiveness of the expected geological formation or formations to be drilled, and other factors. For example, two or more cutters 40, 105 may be placed at the same radial distance from the centerline 21, typically on different blades 30, such as blade 32 and blade 34, and, therefore, would cut over the same path through the formation. Another embodiment includes positioning two or more cutters 40, 105 at only slightly different radii from the centerline 21 of the drill bit 10, again, typically on different blades 30, so that the path that each cutter makes through a geological formation overlaps slightly with the cutter at the next further radial distance from the centerline of the drill bit 10.

The cutters 40, 105 at the same or nearly the same radial distance from the centerline 21 of the drill bit 10 typically, although not necessarily, are on different blades of the drill bit 10. In addition, the distance a given cutter 40, 105 travels during a single revolution of the drill bit 10 increases as the radial distance of the cutter 40, 105 from the centerline 21 of the drill bit 10 increases. Thus, a cutter 40, 105 positioned at a greater radial distance from the centerline 21 of the drill bit 10 travels a greater distance for each revolution of the drill bit 10 than another cutter 40, 105 positioned at a lesser radial distance from the centerline 21 of the drill bit 10. As such, the first cutter at the greater radial distance would wear faster than the second cutter at the lesser radial distance. In view of this, relatively more cutters 40, 105 are positioned relatively more closely together, i.e., with relatively less radial distance separating those cutters 40, 105 (even if on different blades) the greater the absolute radial distance from the centerline 21 of the drill bit 10 (such as those cutters in the blade shoulder section 28) as compared to those cutters 40, 105 positioned relatively closer to the centerline 21 of the drill bit 10, such as those cutters in the cone section 29. Further, as a radial distance of a given cutter 40, 105 increases, other factors related to the cutter position are typically, although not necessarily, selected to be less aggressive, including the exposure, back-rake, and side-rake, as described below.

Figure 2:
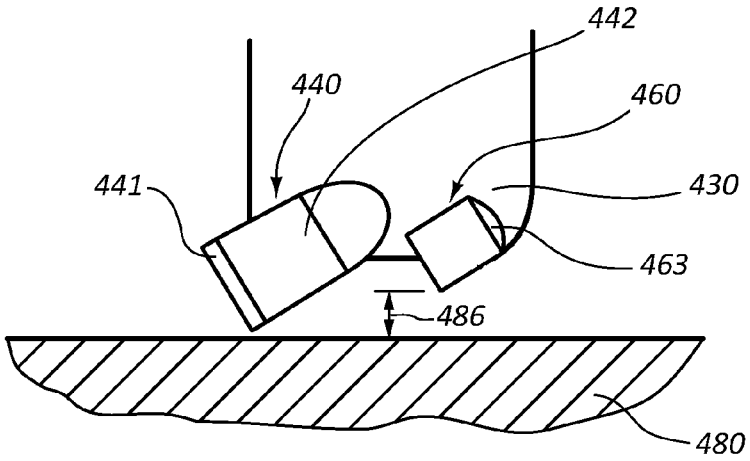
FIG. 2 is a close-view of a cutting element employed in embodiments of the invention.
Figure 3:
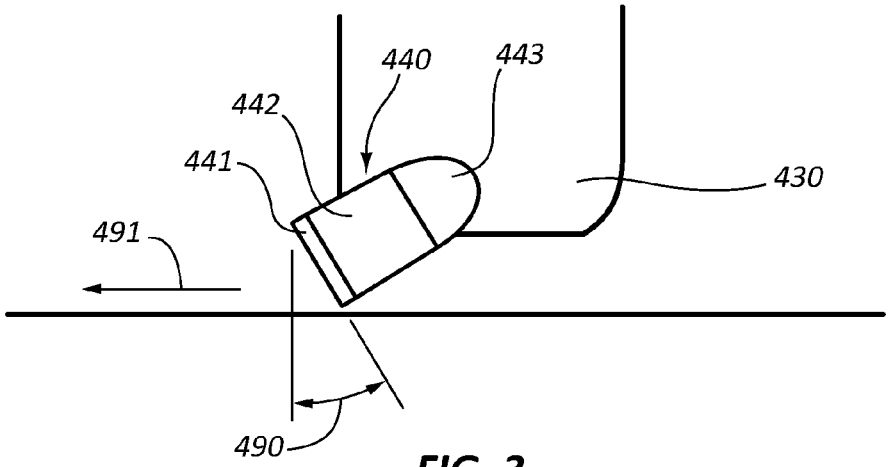
FIG. 3 is a close-view of a cutting element employed in embodiments of the invention.
Figure 4:
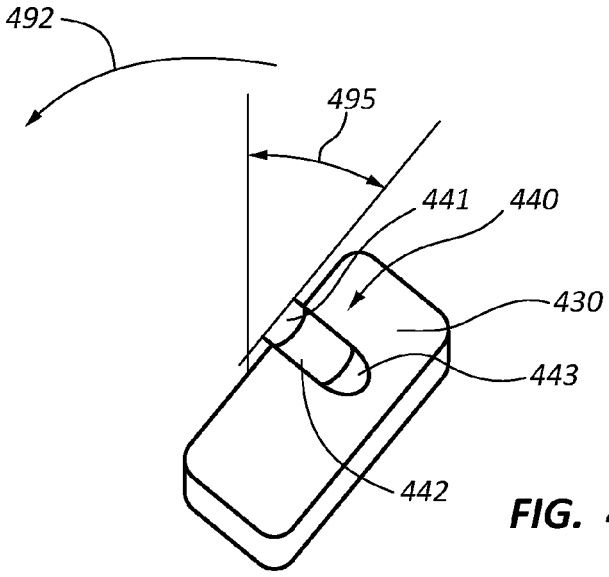
FIG. 4 is a close-view of a cutting element employed in embodiments of the invention.

FIGS. 2, 3, and 4 illustrate various factors related to cutter placement that are considered in their placement in various embodiments illustrated herein. An idealized representation of a cutter 440 illustrated in FIG. 2 cuts or drills the geological formation 480. The cutter 440 with a PDC cutting element 441 and substrate 442 is positioned in the pocket 443 of the blade 430. Of course, other types of cutters as discussed above fall within the scope of the disclosure. Also illustrated in FIG. 2 is an optional backup cutter 460 of a similar hard material as that in the cutter 440 (e.g., it can be one of the types of materials and others known in the art as discussed above, but it need not be the same material as the cutter 440) that can be positioned at approximately the same radial distance from the centerline of the drill bit as the cutter 440 and is typically positioned behind the cutter 440 relative to the direction of rotation of the drill bit on the same blade 430 as illustrated or on another blade of the drill bit. A given backup cutter 460 for a given cutter 440, however, may be positioned in front (relative to the direction of rotation of the drill bit) of the cutter 440 either on the same blade 430 or another blade of the drill bit. The backup cutter 460 illustrated is formed of tungsten carbide and is positioned in pocket 463 of the blade 430. The backup cutter 460 can alternatively be a PDC cutter, synthetic or natural diamond, or other hard cutting element.

The backup cutter 460 illustrated is positioned a distance 486 from the geological formation 480 initially, i.e., before drilling begins. Typically, the backup cutter 460 only begins to engage the geological formation 480 when the cutter 440 wears sufficiently such that the backup cutter 460 begins to drill the geological formation 480. When the backup cutter 460 engages the geological formation 480, it bears a portion of the torque and weight-on-bit (the force on the bit in a direction parallel to the well-bore) that would otherwise have been borne solely by the cutter 440, thereby reducing the wear on the cutter 440 and increasing the life of the cutter 440. While the distance 486 is illustrated as allowing some distance between the geological formation 480 and the backup cutter 460 when the cutter 440 is new (i.e., unworn), the backup cutter 460 can be positioned to engage the geological formation 480 concurrently with the cutter 440 is new, i.e., the distance 486 is effectively zero. In other embodiments, the backup cutter 460 can be designed to engage the geological formation 480 before the cutter 440 does so, i.e., the distance 486 is effectively negative. The distance 486 is selected in consideration of the characteristics of the geological formation to be drilled and other factors known in the art and may vary among different backup cutters at different radial distances from the center of the drill bit.

The cutter 440 illustrated in FIG. 3 is positioned in the pocket 443 of the blade 430 that travels in the direction 491. The angle 490 describes the back-rake of the cutting element 441 relative to the direction of travel 491. The back-rake angle 490 illustrated in FIG. 3 is a negative angle and is considered to be less aggressive and suitable for relatively harder geological formations. A back-rake angle of zero degrees corresponds to the cutting element 441 perpendicular to the direction of travel 491 and is more aggressive and suitable for relatively softer geological formations than a negative back-rake angle. A positive back-rake angle is even more aggressive than a back-rake angle of zero degrees and is suitable for respectively softer geological formations. Thus, the back-rake angle of a selected cutter is chosen in consideration of various factors, including its radial distance from the center of the drill bit, the type of material from which the cutters are formed, the characteristics of the geological formation to be drilled (abrasiveness, hardness, and others known in the art), and the like.

FIG. 4 illustrates the side-rake angle 495 of a cutting element 441 of a cutter 440 relative to the direction of rotation 492. The side-rake angle 495 illustrated in FIG. 3 is a negative angle. A side-rake angle of zero degrees corresponds to the cutting element 441 perpendicular to the direction of rotation 492. A positive side-rake angle is even more aggressive than a back-rake angle of zero degrees. Thus, the side-rake angle of a selected cutter is chosen in consideration of various factors, including its radial distance from the center of the drill bit, the type of material from which the cutters are formed, the characteristics of the geological formation to be drilled (abrasiveness, hardness, and others known in the art), and the like.

Returning to FIGS. 1, 5 and 6 the drill bit 10 optionally includes a gauge pad 45 typically positioned a radial distance from the centerline 21 of one-half of the gauge diameter 46. In other embodiments, the gauge pad 45 is positioned at less than the radial distance, i.e., less than one-half the gauge diameter 46. The gauge pad 45 optionally includes gauge protection 37 (illustrated on FIG. 1), which can be hard-facing and/or a selected pattern of tungsten carbide, PDC, natural or synthetic diamond, and other hard materials to provide increased wear-resistance to the gauge pad 45 to increase the probability that the drill bit 10 substantially retains its gauge diameter 46. The gauge pad 45 also optionally includes a crown chamfer 47 that forms the transition between the gauge pad 45 and the bit body 25.

Drill bit 10 optionally includes one or more gauge cutters 44 (FIG. 1) positioned in the blade shoulder section 27 to provide backup to the cutters at the greatest radial distance from the centerline 21 of the drill bit 10, similar to the backup cutter 464 described above in FIG. 2. Optionally, the gauge cutter 44 can be positioned behind or below a selected cutter 40 or on a separate or different gauge pad 45. The gauge cutter 44 typically is of a smaller size and/or diameter than the cutters 40, but the gauge cutter 44 can also be the same size and or diameter or a larger size and/or diameter than the cutters 40. The gauge cutter 44 can be formed of tungsten carbide, PDC, synthetic or natural diamond, or other hard material.

Other features of the drill bit 10 include one or more nozzle bosses 50 (FIGS. 5 and 6) that are an integral part of the bit body 25. The nozzle bosses 50 have a fixed area through which drilling fluid or drilling mud 55 flows after passing through an inner diameter of the drill string and through the inner diameter or annulus of the drill bit. Typically, the nozzle bosses 50 are configured to receive a jet, nozzle, or port 51 (FIG. 6) of various diameters or sizes and optionally includes threads or other means to secure the jets or nozzles 51 in position within the nozzle boss 50 as known in the art. The jets, ports, or nozzles 51 are typically field replaceable to adjust the total flow area of the jets or nozzles 51 and have a selected diameter chosen to balance the expected rate-of-penetration and, consequently, the rate at which drill cuttings are created by the bit and removed by the drilling fluid, the necessary hydraulic horsepower, and capabilities of the drilling rig facilities, particularly the pressure rating of the drilling rig's fluid management system and the pumping capacity of its mud pumps, among other factors. In some instances, a blank jet nozzle 51 may be placed in a particular nozzle boss 50 preventing any fluid from flowing through that particular boss 50. Such a configuration is useful for jetting operations when initially drilling into the seafloor in a new offshore well. Conversely, no jet nozzle 51 can be used when desired.

Figure 10:
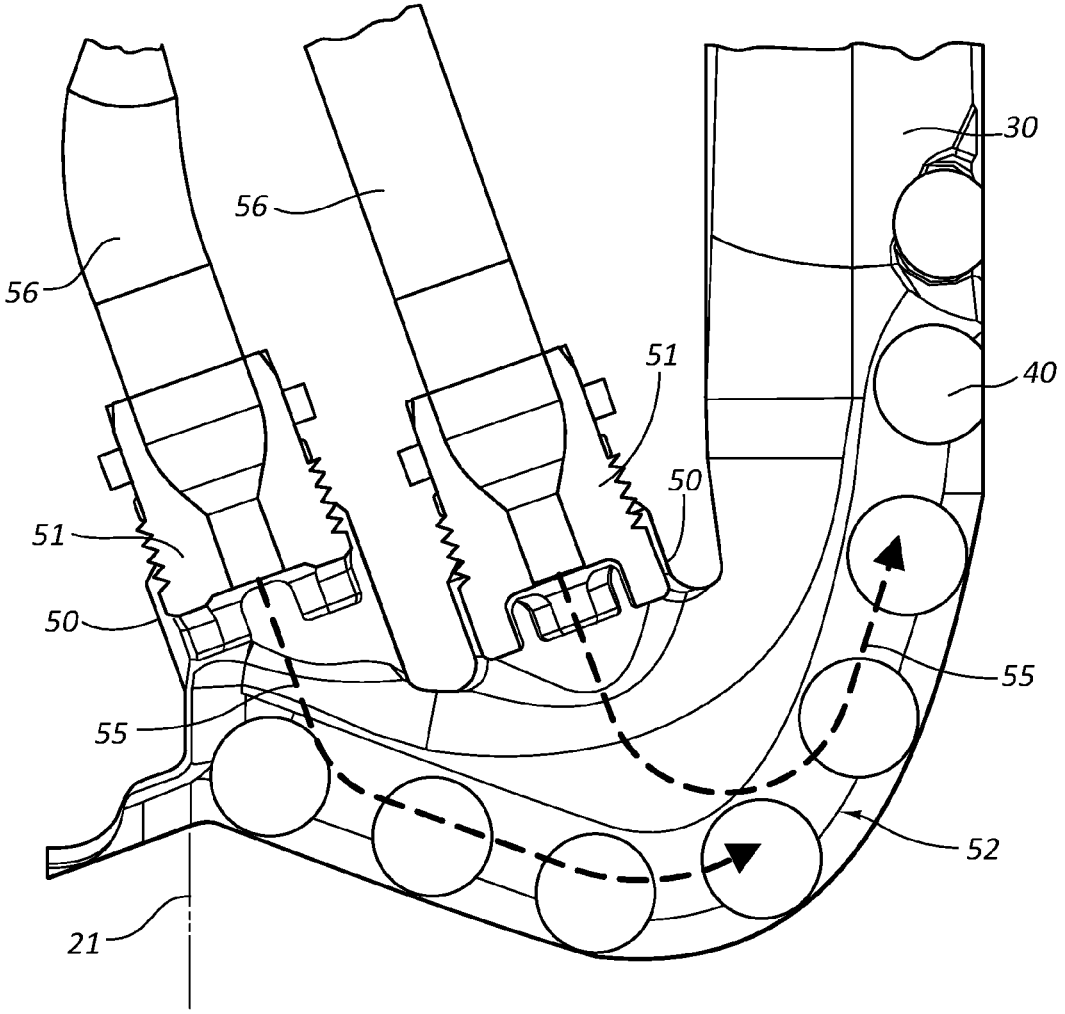
FIG. 10 is a cross-section view of the drill bit in FIG. 1 showing the flow path of the drilling fluid.

The flow path of the drilling fluid 55 is best illustrated in FIG. 10. As illustrated, the various nozzle bosses 50 and jets or nozzles 51 have an orientation selected to enhance the removal of drill cuttings from face of each blade 30 and from the cone section 29 of the bit and move them towards the annulus of the well-bore. Stated differently, the orientation of the nozzle boss 50 and jets or nozzles 51 is such that the drilling fluid 55 cleans the cutters 40 and the blades 31-34 and the recessed cutting elements 105 of the drill bit 10. An idealized representation of the flow path of the drilling fluid 55 across the cutters 40 is illustrated in FIG. 10. The drilling fluid flows from the inner annulus of the drill bit 10 into the flow paths 56, into the nozzle bosses 50 and out the jets or nozzles 51, sweeping drilled formation cuttings out of the fluid channels/junk slots 52, away from the cutters 40, and up the annulus of the well-bore. Turning back to FIG. 6, while six nozzle bosses 50, one for each blade 31-34 and the recessed cutting elements 105, exist, either more or fewer nozzle bosses 50, jets or nozzles 51 can be used as selected for a given situation.

The drilling fluid 55 flows through the fluid channels or junk slots 52, which are sized and positioned relative to the blades 31-34 and the recessed cutting elements 105 based on the expected rate-of-penetration, characteristics of the geological formation, particularly hardness and whether the formation swells or expands in the presence of the drilling fluid used, average size of the formation cuttings created, and other factors known in the art. For example, smaller (i.e., narrower) fluid channels 52 result in a higher fluid velocity with the result that formation cuttings are carried away more easily and quickly from the drill bit 10. However, smaller fluid channels or junk slots 52 raise the risk that one or more of the fluid channels 52 would become blocked by the formation cuttings, resulting in premature or uneven wear of the bit, reduced rate-of-penetration, and other negative effects. Of course, as discussed above, the drilling fluid 55 can flow through the drill string and out the jets or nozzles 51 as is typical, or it can be reverse circulated down the annulus, into the jets or nozzles 51, and up the drill string.

Turning back to FIG. 5, optional elements included within the embodiment of drill bit 10 are illustrated. One or more backup cutters 60 are illustrated in FIG. 10 behind one or more cutters 40. While the backup cutter is illustrated behind a cutter 40 located primarily in the blade flank section 28 and blade shoulder section 27, backup cutters can be position in the cone section 29 of blade 34 and elsewhere. Thus, one or more backup cutters 60 can be positioned behind or in front of any selected cutters 40 on any selected blades 31-34 and the recessed cutting element as illustrated in FIG. 5.

The backup cutters 60 illustrated in FIG. 5 include a PDC cutting element 61, and substrate 62 positioned within a pocket 63 of the plurality of blades 31-34 and the recessed cutting elements 105. The PDC backup cutters 60 are similar to the cutters 40 and may differ only in size and orientation as discussed above with respect to FIGS. 2-4. Alternatively and/or additionally, the backup cutters 60 can be formed of tungsten carbide cutting elements, as well as synthetic and natural diamond, and other hard cutting elements.

Another optional element illustrated in FIGS. 1 and 6 is hardfacing 70, 109 typically applied through welding or brazing, to various locations of the drill bit 10. Hardfacing is an extra-hard or durable treatment to improve wear resistance and typically is applied to gauge pads 45, as discussed above, and, optionally, to the blades 31-34 in the cone section 29, around the cutters 40, 105, and/or to the entire face of the drill bit 10.

Figure 7:
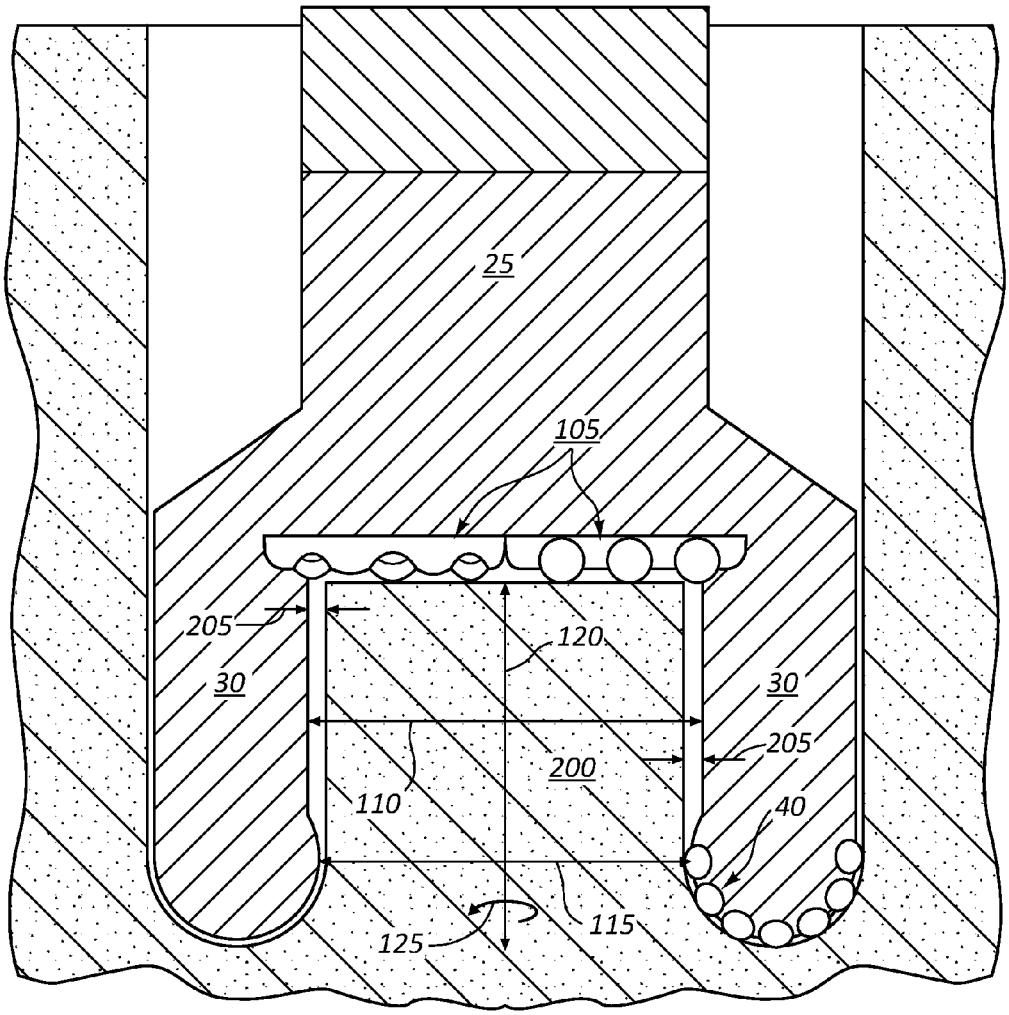
FIG. 7 is a representation of a cross-section of the drill bit in FIG. 1 as it drills a formation.

Turning back to FIGS. 1, 5, and 6, the recessed center portion 100 will be further explained. As noted, the plurality of blades 30, define, in part, the boundaries of the recessed center portion 100. At a bottom of the recessed center portion 100 are at least one and, preferably, a plurality of recessed cutting elements or cutters 105. It should be noted that the term recessed cutting elements 105 refers to their position within the recessed center portion 100 and not, necessarily, that the cutting elements 105 are recessed within the crown or face of the drill bit 10. The recessed cutting elements 105 are positioned in the crown of face 29 of the drill bit body 25 a selected height 120 from the furthest most point of the plurality blades 30 along the axis 21. In addition, the recessed center portion 100 has a first diameter 110 in the inner portion of the recessed portion 100 that is wider than a second diameter 115 that is a diameter between the innermost cutting elements 40 in the crown portion 29 of the drill bit 10, as illustrated in FIGS. 6 and 7 and as will be explained further below. The height 120, the first diameter 110, and the second diameter 115 can be of any dimension and ratio, although it is preferable that a height-width ratio (height 120 divided by first diameter 110) is greater than 1.

Further, because the first diameter 110 and second diameter 115 are different, the core 200 (illustrated in FIG. 7 and as will be explained below) will have a space 205 between the core 200 and the blades 30 that is constant, although in other embodiments the space 205 varies and, preferably, increases in length the closer the measurement is made to the recessed cutting elements 105.

An advantage of this recessed center portion is that, as noted above, the recessed cutting elements 105, as with all cutting elements positioned near the axis 21, have a relatively low rotational velocity relative to those cutting elements further from the axis 21. This makes the process of cutting the formation near the axis 21 more difficult and slower than it is for cutting elements further from the axis 21. To in part alleviate this problem, the cutting elements 40 on the plurality of blades 30 cut a core 200 (FIG. 7) that is then cut by the action of the recessed cutting elements 105. In contrast to the prior art solutions, drilling the core 200 relieves the confining stress of the formation that holds the rock and minerals together and allows the recessed cutting elements 200 to more effectively and efficiently cut the core 200 at their slower rotational velocity than would other wise be the situation if the cutting elements 105 were not in the recessed portion and were instead simply cutting the formation rather than a core. It is believed that embodiments of the present invention provide improved results (increased rate-of-penetration, or ROP) because the performance of the drill bit is not as limited by the slowest rotational velocity.

In addition, as noted, the drilling of the core 200 creates a space 205 created between the width of the core 200 (which is substantially equal to the second diameter 115). It is believed that the prior art did not have this space 205 between the core 200 and the blades 30 because it could create a tendency for the bit to be unstable and, potentially, leading to whirl. Indeed, it is believed that the prior art deliberately typically balanced those drill bits to create a force applied directly to the core in order to improve stability. Embodiments of this drill bit, however, do not have a force designed to be applied to the core 200 because the space 205 prevents the transmission of such a designed balancing force to the core 200. Indeed, it could be counterproductive to do so because a purpose of the space 205 is to relieve the confining stress on the column so that it will be cut more easily by the recessed cutters 105. Further, applying any sort of designed balancing force to the core, given the space 205, could increase instability. Instead, as noted above, considered placement of the plurality of blades 30 and the cutting elements 40, 105 leads to a balanced bit without having to resort to designing a balancing force to be applied to the core 200.

Figure 11:
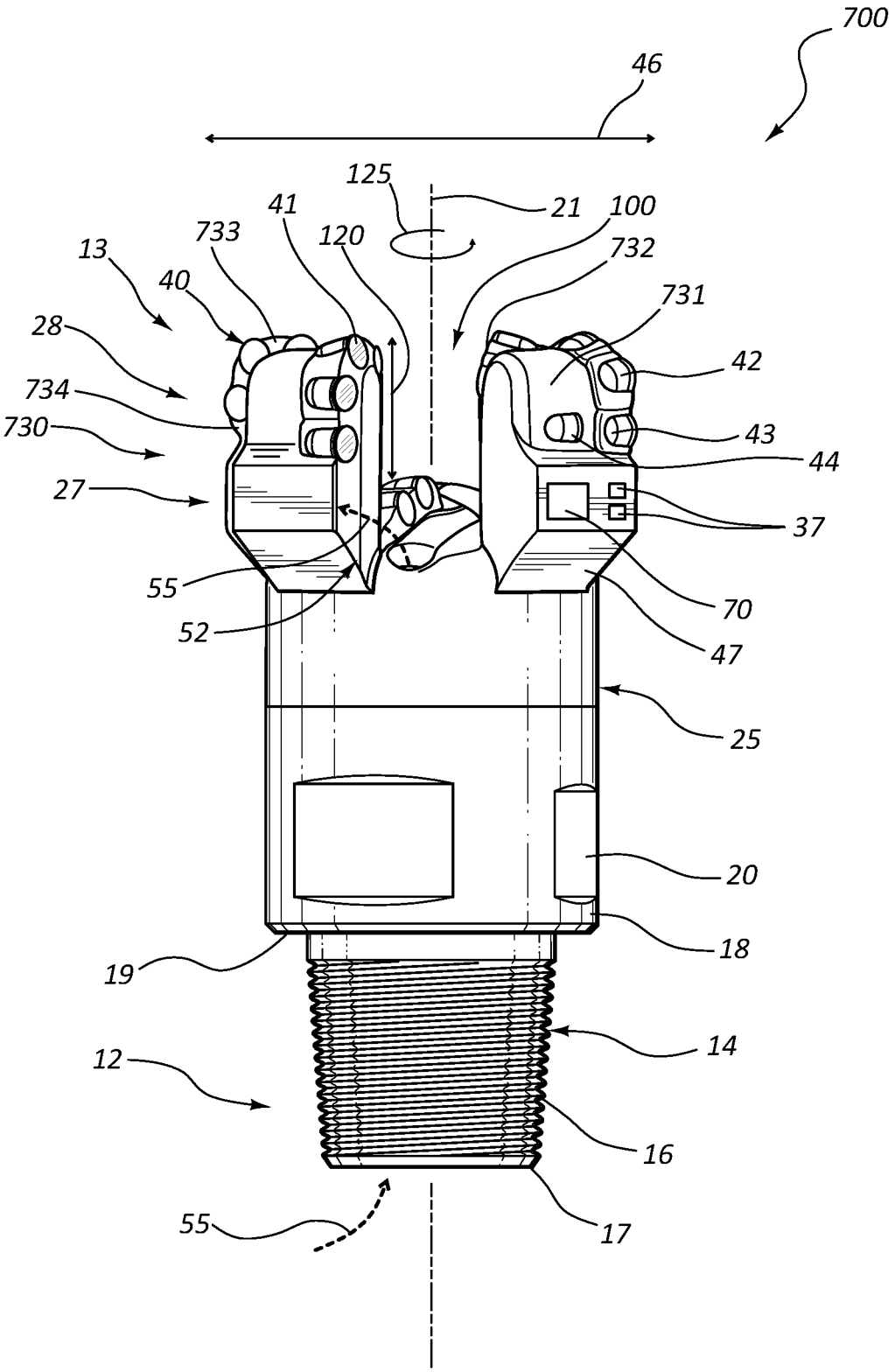
FIG. 11 is a is a side-view of another embodiment of a drill bit.
Figure 12:
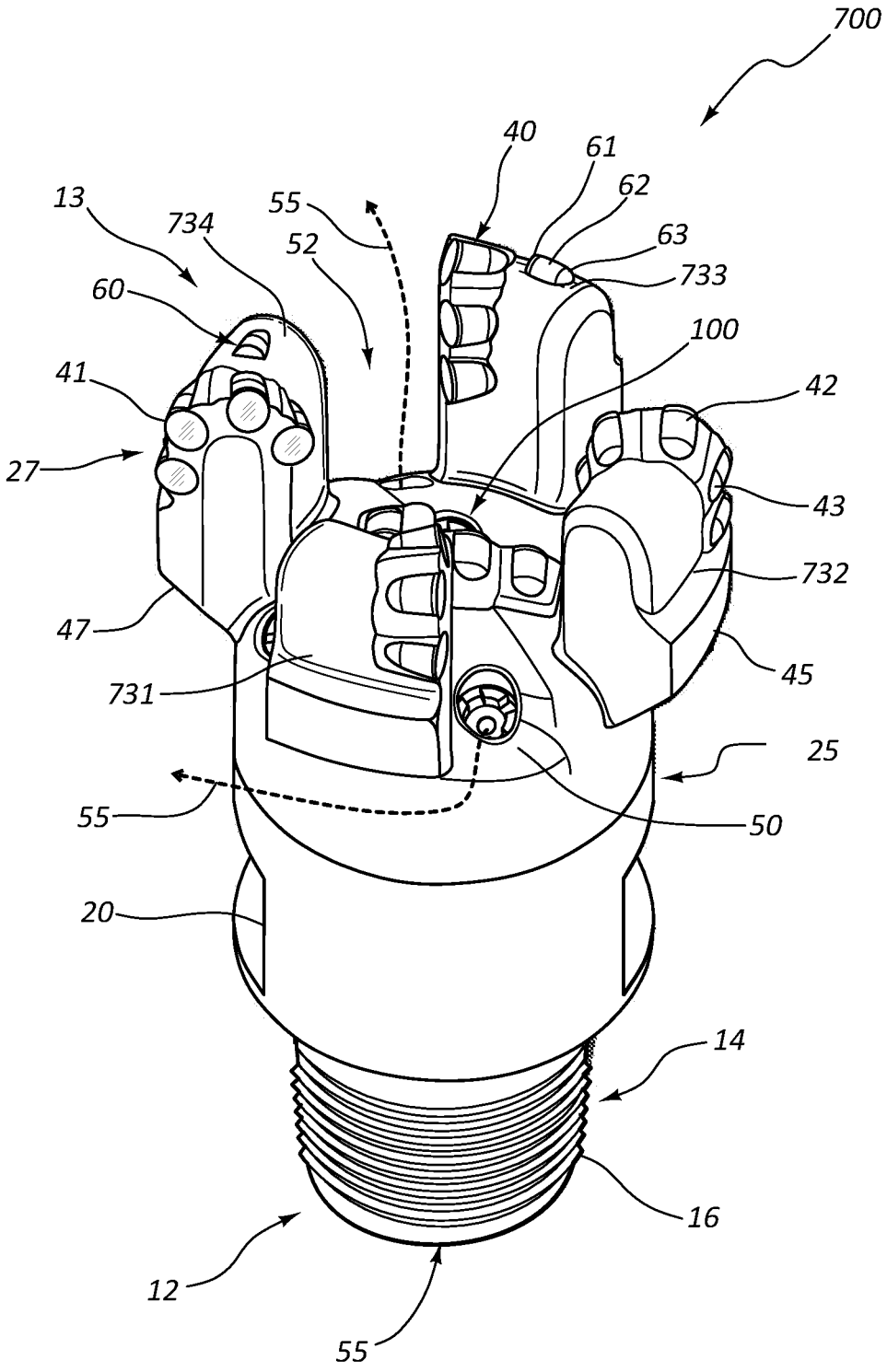
FIG. 12 is an isometric view of the drill bit in FIG. 11.
Figure 13:
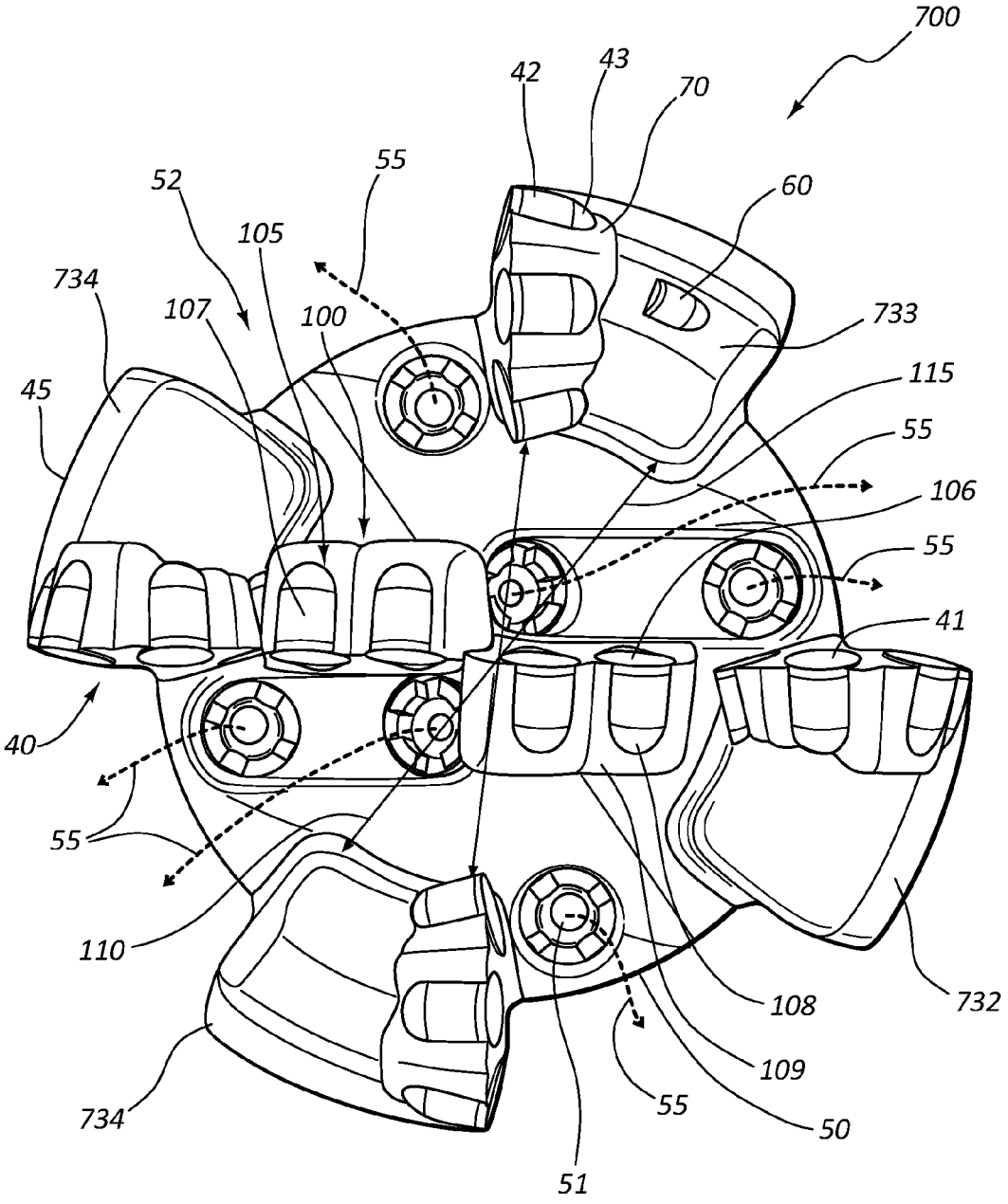
FIG. 13 is a top-view of the drill bit in FIG. 11.

FIGS. 11, 12, and 13 illustrate another embodiment 700 of a drill bit that falls within the scope of the invention. Elements in common with the embodiment illustrated in FIGS. 1, 5, and 6 use the same element numbers and, therefore, will not be repeated here for brevity. A difference in the embodiment illustrated in FIGS. 11-13 is that the drill bit 700 includes a plurality of blades 730, which, in this instance, includes blades 731, 732, 733, and 734. Of course, a greater or lesser number of blades fall within the scope of the disclosure. As best illustrated in FIG. 13, two of the blades, 732 and 734, are approximately in a line or plane with the recessed cutting elements 105 located in the recessed center 100. This compares to the recessed cutting elements 105 that are not approximately in a line or a plane with the blades 32 and 34 of drill bit 10, as illustrated in FIG. 6. Thus, it can be seen that various embodiments of the invention include blades 30, 730 that have varying orientations relative to each other and to the recessed cutting elements 105.

Methods of building a drill bit that falls within the scope of the disclosure are also disclosed. A bit body is formed with one or more drill bit blades connected thereto that extend past the bit body in both a radial direction from the centerline of the bit and a vertical direction towards and proximate to the second end 13 of the drill bit 10 as illustrated in FIG. 1. The bit body can be formed integrally with the drill bit blades, such as being milled out of a single steel blank. Alternatively, the drill bit blades can be welded to the bit body. Another embodiment of the bit body and blades is one formed of a matrix sintered in a mold of selected size and shape under temperature and pressure, typically a tungsten carbide matrix with a nickel binder, with drill bit blades also integrally with the bit body. A steel blank in the general shape of the bit body and the drill blades can be used to form a scaffold and/or support structure for the matrix.

A selected number of blades are milled or molded to have a selected shape in consideration of various factors, including the geophysical properties of the formation to be drilled as described above. The blades may be symmetric or asymmetric relative to the drill bit body and to each other, as illustrated in the figures. In addition, the blades are configured such that a recessed portion lies between the blades.

The bit body is attached, joined, or fixedly coupled to a connection, such as a pin connection described above, that is configured to connect the drill bit to a drill string, downhole motor, or other means of applying a rotary force or torque to the drill bit. The bit body also can be formed integrally with the connection from a steel blank or a steel connection can be welded to the bit body.

The inner annulus of the drill bit can be milled out of the connection. The nozzles, jets, ports, fluid channels and junk slots within the drill bit body, and one or more pockets in each of the drill bit blades configured to receive a cutter also can be milled out of the drill bit body. Alternatively, if the drill bit is formed from a matrix, special blanks may be placed within the mold at the location of the various features, such as the jets, nozzles, fluid channels, junk slots, and through holes with the matrix sintered about the blanks. Once the drill bit body is removed from its mold after the sintering process the blanks can be removed from the drill bit body, thereby revealing the desired hole or feature in the drill bit body. Any imperfections in the molding process can be removed through finish milling or other similar tool work.

Cutters configured to be received in the pockets in the drill bit blades and in the recessed portion of the drill bit are provided, the cutters including a means of securing the cutters within the through holes, such as by heat pressing or fitting, press-fitting, brazing, and other means known in the art. For example, the bit body may be heated to a temperature just below the melt temperature of the braze. The pocket into which a cutter is to be placed is locally heated to melt the braze and a preheated cutter is then placed in the pocket. The drill bit and cutter are allowed to cool, allowing the braze to solidify.

Optional features such as gauge or backup cutters are positioned in either pockets milled or molded to receive them. Hardfacing is optionally applied in various locations as described above, as is any selected gauge protection.

The one or more present inventions, in various embodiments, includes components, methods, processes, systems and/or apparatus substantially as depicted and described herein, including various embodiments, subcombinations, and subsets thereof. Those of skill in the art will understand how to make and use the present invention after understanding the present disclosure.

Embodiments, features, and methods disclosed herein can be used in other drill bits. For example, the disclosures of Drill Bits For Earth Boring contained in U.S. patent application Ser. No. 12/714,418 to Mark L. Jones et al., filed Feb. 27, 2010 and U.S. patent application Ser. No. 12/753,690 to Mark L. Jones and Kenneth M. Curry, filed Apr. 2, 2010, the disclosures of which are each incorporated by this reference for all purposes, are able to incorporate some or all of the embodiments, features, and methods disclosed in the present application.

The present invention, in various embodiments, includes providing devices and processes in the absence of items not depicted and/or described herein or in various embodiments hereof, including in the absence of such items as may have been used in previous devices or processes, e.g., for improving performance, achieving ease and/or reducing cost of implementation.

The foregoing discussion of the invention has been presented for purposes of illustration and description. The foregoing is not intended to limit the invention to the form or forms disclosed herein. In the foregoing Detailed Description for example, various features of the invention are grouped together in one or more embodiments for the purpose of streamlining the disclosure. This method of disclosure is not to be interpreted as reflecting an intention that the claimed invention requires more features than are expressly recited in each claim. Rather, as the following claims reflect, inventive aspects lie in less than all features of a single foregoing disclosed embodiment. Thus, the following claims are hereby incorporated into this Detailed Description, with each claim standing on its own as a separate preferred embodiment of the invention.

Moreover, though the description of the invention has included description of one or more embodiments and certain variations and modifications, other variations and modifications are within the scope of the invention, e.g., as may be within the skill and knowledge of those in the art, after understanding the present disclosure. It is intended to obtain rights which include alternative embodiments to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. A drill bit for earth boring, said drill bit comprising:

a bit body having a first end and a second end spaced apart from said first end;

a connection means connected to said bit body at said first end for coupling said bit body to a rotating means for providing rotational torque to said bit body;

a plurality of blades connected to said bit body at said second end, said plurality of blades forming a recessed portion therebetween, said recessed portion having a height extending from said bit body to a top of said plurality of blades, said recessed portion further having a first diameter and a second diameter less than said first diameter; and, at least one cutting element disposed upon one of said plurality of blades and another cutting element disposed within said recess upon said bit body.

2. The drill bit of claim 1, further comprising a ratio of said height to said first diameter that is greater than 1.

3. The drill bit of claim 1, further comprising a flow path and a nozzle boss through which a drilling fluid flows.

4. The drill bit of claim 1, wherein said cutting element is selected from a group consisting of a polycrystalline diamond compact, natural diamond, synthetic diamond, and tungsten carbide.

5. The drill bit of claim 1 wherein the second diameter is farther from the bit body than the first diameter.

6. The drill bit of claim 5 wherein the first diameter is a diameter of an innermost cutting element from said at least one cutting element disposed upon one of said plurality of blades.

7. A drill bit for earth boring, said drill bit comprising:

a bit body having a first end and a second end spaced apart from said first end;

a connection configured to couple said first end to a drill string;

a plurality of blades connected to said bit body at said second end, said plurality of blades configured to form a recessed portion therebetween, said recessed portion having a height extending from said bit body to a top of said plurality of blades, said recessed portion further having a first diameter, said height having a ratio to said first diameter selected to relieve a confining stress exerted upon a core that is cut by said drill bit and forms within a space between said plurality of blades and said recessed portion during a drilling operation; and at least one cutting element disposed upon one of said plurality of blades and another cutting element disposed within the recess upon said bit body.

8. The drill bit of claim 7, wherein said recessed portion further comprises a second diameter less than said first diameter.

9. The drill bit of claim 7, further comprising a flow path and a nozzle boss through which a drilling fluid flows.

10. The drill bit of claim 7, wherein said cutting element is selected from a group consisting of a polycrystalline diamond compact, natural diamond, synthetic diamond, and tungsten carbide.

11. A method of drilling a well bore, said method comprising:

positioning a drill bit coupled to a drill string in said well bore and in contact with a formation to be drilled, said drill bit including:

a bit body having a first end and a second end spaced apart from said first end;

a connection configured to couple said drill bit first end to a drill string;

a plurality of blades connected to said bit body at said second end, said plurality of blades configured to form a recessed portion therebetween, said recessed portion having a height extending from said bit body to a top of said plurality of blades, said recessed portion further having a first diameter and a second diameter less than said first diameter; and at least one cutting element disposed upon one of said plurality of blades and another cutting element disposed upon said bit body within said recessed portion between said plurality of blades;

rotating said drill bit to cut said formation, said rotating causing a core of said formation to form in a space between said plurality of blades and said recessed portion, thereby relieving a confining stress on said core; and cutting said core with said another cutting element.

12. The method of claim 11, wherein said drill bit further comprises a ratio of said height to said first diameter that is greater than 1.

13. The method of claim 11, further comprising pumping a drilling fluid that flows through a flow path and a nozzle boss of said drill bit.

14. The method of claim 11, wherein said cutting element is selected from a group consisting of a polycrystalline diamond compact, natural diamond, synthetic diamond, and tungsten carbide.

* * * * *